US005269079A

United States Patent [19]

Kunstadt

[11] Patent Number: 5,269,079

[45] Date of Patent: Dec. 14, 1993

[54] SKI FOOTWEAR

[76] Inventor: Robert M. Kunstadt, 470 W. End Ave. 4G, New York, N.Y. 10024

[21] Appl. No.: 846,528

[22] Filed: Mar. 4, 1992

[51] Int. Cl.[5] ..... A43B 5/04

[52] U.S. Cl. ..... 36/117; 36/120

[58] Field of Search ..... 36/117, 118, 119, 120, 36/121

[56] References Cited

U.S. PATENT DOCUMENTS

| | | | |
|---|---|---|---|
| 3,686,778 | 8/1972 | Hornung | 36/120 |
| 3,747,235 | 7/1973 | Post | 36/2.5 AL |
| 3,807,060 | 4/1974 | Hanson | 36/118 |
| 3,945,135 | 3/1976 | Hanson et al. | 36/118 |
| 4,253,251 | 3/1981 | Salomon | 36/120 |
| 4,584,782 | 4/1986 | Thatcher | 36/11.5 |
| 4,748,749 | 6/1988 | Colvard | 36/2 R |
| 4,793,075 | 12/1988 | Thatcher | 36/11.5 |
| 4,959,912 | 10/1990 | Kaufman et al. | 36/117 |
| 4,979,760 | 12/1990 | Derrah | 36/120 |

FOREIGN PATENT DOCUMENTS

| | | | |
|---|---|---|---|
| 0286586 | 10/1988 | European Pat. Off. | 36/117 |
| 2224057 | 5/1972 | Fed. Rep. of Germany . | |
| 2119216 | 10/1972 | Fed. Rep. of Germany | 36/118 |
| 2718939 | 4/1977 | Fed. Rep. of Germany . | |

OTHER PUBLICATIONS

L. L. Bean, Spring Weekend 1992, pp. 2, 21.

Windance Sailboards, Winter 1992, p. 5.

"Summer Health and Fitness", New York Magazine, Apr. 27, 1992, p. 4A.

*Primary Examiner*—Steven N. Meyers

*Assistant Examiner*—M. D. Patterson

[57] ABSTRACT

An article of footwear for skiing comprises a rigid-soled sandal attached to the foot with straps; a three-part hinge mechanism located behind the heel for stabilizing the leg laterally while permitting flexing at the knee; and a breathable, waterproof insulating outer covering; thereby providing a comfortable, warm and dry environment for the foot while permitting edge control of the ski.

7 Claims, 2 Drawing Sheets

SKI FOOTWEAR

BACKGROUND OF THE INVENTION

1. Field of the Invention

This invention relates to the field of footwear for use in the sport of downhill (alpine) skiing.

2. Description of Related Art

A conventional method of affixing the foot of a skier to a downhill (as distinguished from cross-country) ski is by means of a molded plastic rigid-shell boot. The inside of the boot is padded with a resilient plastic foam liner, in order to approximate a fit to the foot. The forces from the foot to the ski for control of the ski are therefore transmitted first to a foam liner, thence to the plastic boot shell, finally to the ski binding, which grips the boot at toe and heel.

Boots of this type are notoriously uncomfortable, since in order to permit fine control of the ski the fit must be tight. Since the foot of each individual differs, it is not easy to make a boot that can fit many people both tightly and comfortably. If a boot is loose or has very soft padding, and therefore is comfortable, it offers little control. Some boots therefore are made with the foam molded in place to the foot of the individual wearer, but this is a relatively expensive customization process. Moreover, even in a boot of the latter type, the foot may become uncomfortable because the plastic shell is waterproof and the foam liner encloses the entire foot, therefore inhibiting the evaporation of perspiration, so that perspiration from the wearer's foot permeates the boot by the end of a strenuous day of skiing.

OBJECTS OF THE INVENTION

It is therefore an object of the invention to provide footwear for downhill skiing that permits precise control of the skis, while being comfortable to wear and keeping the foot dry and warm. It is a further object to make such footwear of a weight that is not substantially more than that of a rigid plastic shell construction, and ideally less; and with an external appearance that does not deviate unduly from a conventional ski boot in size or shape. Such footwear should also be easy to manufacture and adaptable to a wide range of foot shapes, without custom fitting.

SUMMARY OF THE INVENTION

In the present invention, these objects are achieved by use of a space-frame style of construction rather than a rigid outer shell configuration. Warmth and waterproofing are provided by an outer covering made of a flexible material such as nylon packcloth, which may be lined with a breathable waterproof GORE-TEX fabric and with such thickness of insulation (optionally removable) as may be appropriate for the season. The outer covering does not provide the structural connection from foot to ski. Instead, this is accomplished by means of a space-frame comprising a rigid sole and a hinge system for connecting the sole to the leg at its narrow point above the ankle. The foot and leg are secured to this frame by webbing straps, in the manner of a sandal. Therefore, the foot is not enclosed in the viselike all-encompassing grip of the conventional boot.

The hinge structure is essential to the workings of the invention. Since the knee of a skier must be free to flex forward in order to ski properly (as in doing deep-knee bends), a conventional boot is hinged at or below the ankle, to facilitate such movement. However, due to its tight fit; the stiffness of the plastic; and the fact that the boot hinge is rarely able to be positioned precisely over the pivot point of the ankle joint of each individual skier, such a conventional boot hinge resists flexing. As it does flex, the padding of the boot liner may rub over the wearer's sock, as the leg repositions itself in the boot. This can cause blisters, which is what happened to the inventor and initiated this work.

In the invention, the hinge structure does not contact the leg except at one place, preferably the narrow region above the ankle. The hinge structure of the invention permits the knee to flex forward, while restraining it from undesirable side-to-side motion, without creating rubbing forces on the leg. It is not necessary to determine the exact ankle joint pivot position of each wearer, in order to permit the hinge structure to operate correctly.

This is accomplished by utilizing a hinge system having not just one hinge, as in the conventional boot, but three, arranged such that the cuff attaching the hinge system to the leg of the wearer is able to move freely forward/back and up/down, but not side to side. Therefore, the wearer is able to control the edging action of the skis, and to bend the knees forward as required to weight the tips of the skis, without the need for an unduly restrictive and hence uncomfortable full-foot rigid-shell boot; and regardless of the exact parameters of the skier's foot, in particular ankle pivot position.

To the extent energy storage capacity is desired for aiding the skier in returning from the knees-bent position to an upright posture, this can be provided by an energy storage means such as a spring cooperating with the hinge structure. The desired spring rate and load capacity can therefore be selected entirely independently of the construction of the footwear itself.

DETAILED DESCRIPTION OF THE INVENTION

The invention will now be described in detail, with reference to the accompanying drawings.

Figure 2:
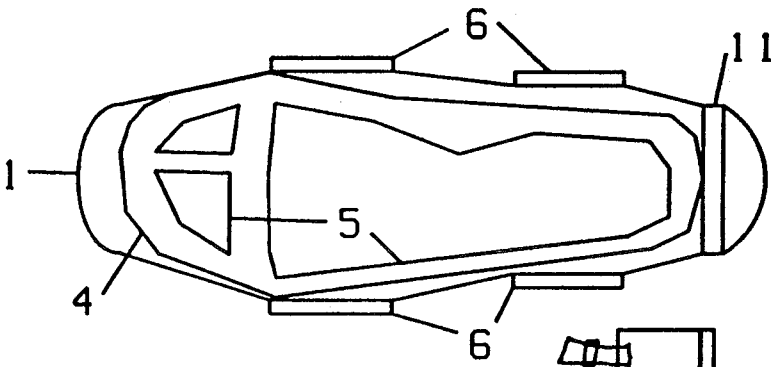
FIG. 2 is a top plan view of the footbed of an article of ski footwear according to the invention.
Figure 1:
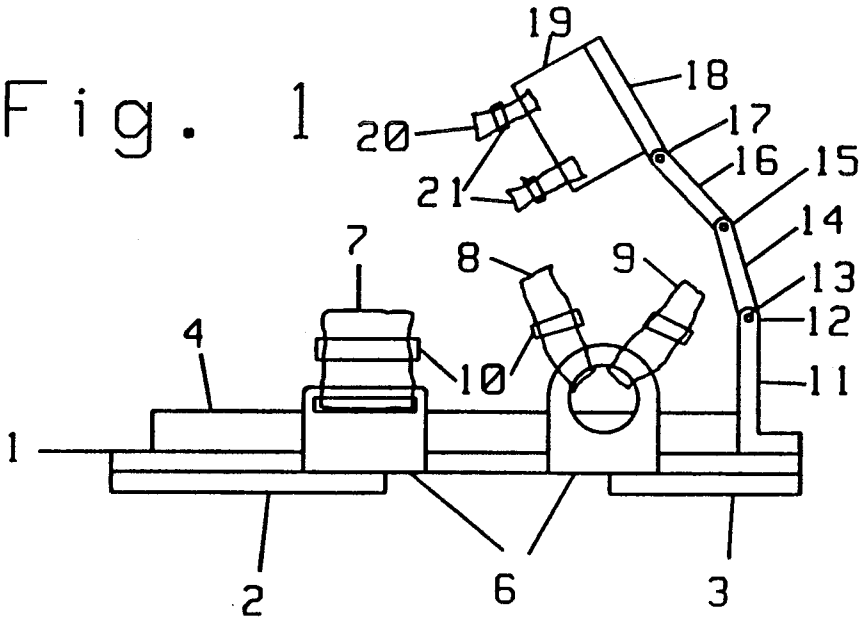
FIG. 1 is a left side elevation of the load-bearing structure of an article of ski footwear according to the invention, with the hinge structure in its extended position.
Figure 3:
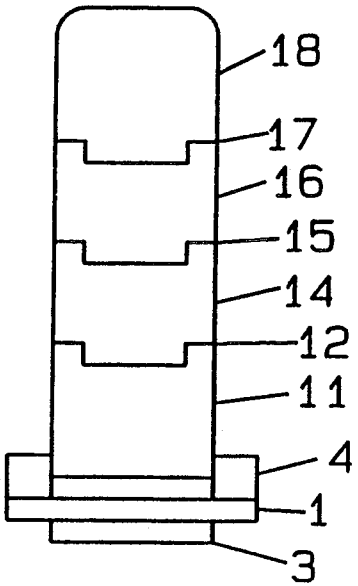
FIG. 3 is a rear elevation of the hinge structure of an article of ski footwear according to the invention.

Referring to FIGS. 1-3, sole 1 is a rigid aluminum plate extending the whole length of the structure. It may be provided with cutouts or milled recesses to save weight. Affixed to its underside are toe 2 and heel 3, of rubber or plastic. Affixed to its top surface is footbed 4 of rubber or plastic foam, or cork, and having a top surface provided with indentations 5 for conformance to the underside of the foot.

Anchors 6 of aluminum are affixed to sole 1 and extend upwardly to receive webbing straps 7, 8 and 9. Said straps are of nylon and may be padded with neoprene if desired. They are secured to the foot with adjustable buckles 10. They may optionally be adjustably secured with VELCRO hook and loop tape, or other suitable means. Strap 7 encircles the foot just behind the ball of the foot and may be 2" wide. Strap 8 encircles the foot at the instep and strap 9, at the heel. These straps may be 1" wide. The function of said straps 7–9 is to hold the foot down against the footbed and to facilitate steering of the skis left and right by means of pressure transmitted by the toes and heels of the skier. Alternative strap arrangements may be utilized to accomplish the same purpose as will be appreciated by those skilled in art.

Note that sole 1 is longer than footbed 4, sufficient to permit sole 1 to be engaged by the ski bindings at the heel and toe regions.

Hinge support 11 of aluminum is affixed to sole 1 and extends upwardly behind the heel of the wearer. It terminates in first hinge 12 which pivots about hinge pin 13 of steel. First hinge extension 14 of aluminum cooperates with hinge support 11 to provide a hinge action about pin 13.

First hinge extension 14 terminates in second hinge 15. Cooperating therewith is second hinge extension 16 of aluminum, which terminates in third hinge 17.

Cooperating with said third hinge 17 is leg support 18 of aluminum. Leg support 18 is provided with cuff 19 of rigid or semi-rigid plastic, or aluminum, which is semicircular in cross-section and is generally adapted to the curve of the back of the leg in the region above the ankle. It may optionally be padded. It is provided with straps 20 having buckles 21, for securing cuff 19 to the leg.

Figure 4:
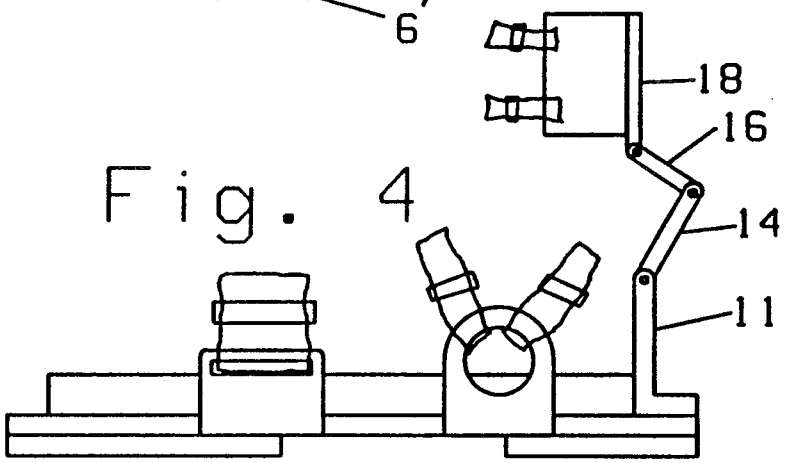
FIG. 4 is a left side elevation of the load-bearing structure of an article of ski footwear according to the invention, with the hinge structure in its retracted position.

Referring now to FIG. 4, it can be appreciated that the hinge structure above-described permits the leg of the wearer to stand upright in the footwear of the invention, as is shown by the position of hinge elements 11, 14, 16 and 18 in FIG. 4. At the same time, essentially no sideways movement is permitted, as can be appreciated from FIG. 3, due to the rigidity of said hinge structure on application of sideways forces. Returning now to FIG. 1, observe the relative position of the hinge elements with the hinge structure in its extended position, as when the skier bends the knee down and forward. In this manner, due to the fact that cuff 19 is constrained to move substantially only in a plane lying normal to the plane of sole 1 and parallel to its longitudinal axis (i.e., forward/back and up/down, but not sideways), good control of the skis can be provided, without encasing the foot in an unduly restrictive, clammy shell.

It will be appreciated that alternative mechanical systems having the same function of extension and retraction without substantial lateral movement, may be substituted for hinge extensions 14 and 16 and hinge 15, e.g., a telescoping ball-bearing slide mechanism such as that used as a cabinet draw slide. However, the preferred system here described in detail is simple, reliable and effective, and hence an elegant solution to the problem.

Figure 5:
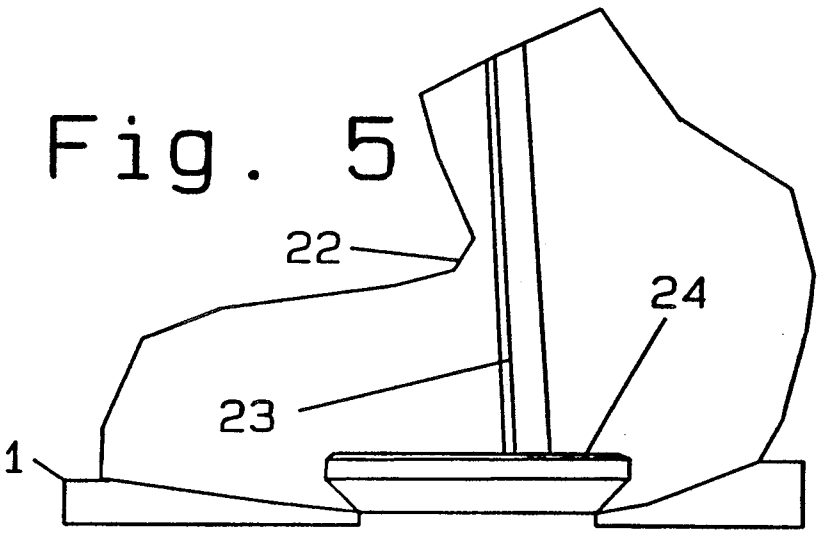
FIG. 5 is a left side elevation of an article of ski footwear according to the invention, with its external covering in place.

Referring now to FIG. 5, it can be seen how removable external covering 22 substantially encloses the structure of the invention, except for the toe and heel regions which must engage the ski bindings. Covering 22 is provided with VELCRO closure tabs 23 and 24, to permit its opening and closing and adjusting of the various straps 7–9 and 20–21. Covering 22 is installed by wrapping it about the leg and foot wearing the footwear of the invention and closing tab 23. Tab 24 is then brought under sole 1 (from the right side to the left) and secured to the left side of covering 22.

Covering 22 may be of CORDURA packcloth and may be lined with neoprene or breathable GORE-TEX fabric (or equivalent) for waterproofing, and insulated as desired with fixed or removable insulating pads, similar to gaiters (boot covers) known to those skilled in the art. Covering 22 plays no role in the attachment of the foot to the ski, and hence is susceptible of a wide range of alternative constructions, depending on weather conditions. The skier may have a variety of such coverings 22 from which to choose. Note that in a conventional boot, the amount of padding cannot be changed without affecting the boot's ability to link the foot to the ski.

Figure 6:
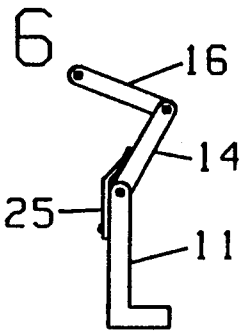
FIG. 6 is a detail of an embodiment of the hinge structure of FIG. 4, showing an optional retraction spring.

Referring now to FIG. 6, in this embodiment spring clip 25 screwed to hinge support 11 urges hinge extension 14 rearwardly, thereby biasing the entire hinge structure towards its retracted position. As the skier bends the knee, energy is stored in spring clip 25, which can be released on the return stroke to aid the skier in extending the leg. By selecting the spring rate and load capacity of spring clip 25, the desired energy storage profile may be achieved. This is somewhat like certain prior art rigid-shell boots, in which an adjustable spring along the heel may be used to vary the boot flex to a limited extent. By having a variety of interchangeable spring clips 25, the demanding skier, such as a ski racer, can easily adapt the performance properties of the footwear of the invention to particular course conditions, over a wide range from zero spring action to extremely stiff spring action. It will be appreciated that not just a spring clip, but other energy storage devices such as fiberglass rods or gas cylinders, may be applied to the same effect, within the teachings of the invention.

It will also be appreciated that structurally appropriate alternative materials may be substituted for those specified above, and that the invention may be varied or modified consistent with accomplishing its objects, in a manner that will be apparent to one skilled in the art.

I claim:

1. An article of ski footwear comprising:

sole means adapted for permitting detachable affixation of said article to a ski with the longitudinal axis of said sole means being essentially aligned with the longitudinal axis of said ski;

cuff means for detachable encirclement of and affixation to the leg of a skier at a region above the ankle; and strut means for spatially positioning said cuff means with respect to said sole means, said strut means being interposed between said sole means and said cuff means and connected thereto; said cuff means being positioned with respect to said sole means substantially only by said strut means;

said sole means being provided with restraining means for detachably attaching the foot of said skier to said sole means;

said strut means being provided with first pivot means having a corresponding first pivot axis for hingedly attaching said strut means to said sole means and permitting rotational movement of said strut means and said cuff means with respect to said sole means about said first pivot axis disposed essentially perpendicular to an imaginary line parallel to said longitudinal axis of said ski;

said strut means being further provided with second pivot means for hingedly attaching said strut means to said cuff means and permitting rotational movement of said cuff means with respect to said strut means about a second pivot axis disposed essentially parallel to said first pivot axis and spaced therefrom;

said strut means being further provided with extension means for varying the distance from said second pivot means to said first pivot axis while maintaining said second pivot axis substantially parallel to said first pivot axis, said extension axis being interposed between said first pivot means and said second pivot means; and said extension means permitting relative movement of said second pivot axis toward and away from said first pivot axis in a predefined, substantially straightline path over a predetermined range, in response to forces exerted upon said cuff means and said sole means by said skier.

2. An article of ski footwear according to claim 1, said extension means comprising a third pivot means for varying the configuration of said strut means, said third pivot means defining a third pivot axis essentially parallel to said first and second pivot axes and spaced therefrom.

3. An article of ski footwear according to claim 1, said article further comprising a flexible, water-resistant outer covering removably affixed to said sole means.

4. An article of ski footwear according to claim 2, said article further comprising a flexible, water-resistant outer covering removably affixed to said sole means.

5. An article of ski footwear according to claim 3, said strut means being further provided with energy-storage means for storing and releasing forces acting upon said cuff means and said sole means.

6. An article of ski footwear according to claim 4, said strut means being further provided with energy-storage means for storing and releasing forces acting upon said cuff means and said sole means.

7. An article of ski footwear according to claim 6, said energy-storage means comprising a spring.

* * * * *